US006929151B1

(12) United States Patent
Clayton

(10) Patent No.: US 6,929,151 B1
(45) Date of Patent: Aug. 16, 2005

(54) WATER PROJECTING TOY

(76) Inventor: Richard A. Clayton, 71 Humboldt St., Simi Valley, CA (US) 93065

( * ) Notice: Subject to any disclaimer, the term of this patent is extended or adjusted under 35 U.S.C. 154(b) by 0 days.

(21) Appl. No.: 10/873,563

(22) Filed: Jun. 21, 2004

Related U.S. Application Data

(60) Provisional application No. 60/480,026, filed on Jun. 21, 2003.

(51) Int. Cl.[7] ..... A63H 3/18

(52) U.S. Cl. ..... 222/79; 141/346

(58) Field of Search ..... 222/79, 210, 212; 141/346

(56) References Cited

U.S. PATENT DOCUMENTS 4,803,974 A * 2/1989 Powell ..... 222/79
5,141,132 A * 8/1992 Whelan ..... 222/79
5,360,142 A * 11/1994 Stern et al. ..... 222/79

* cited by examiner

*Primary Examiner*—Philippe Derakshani

(57) ABSTRACT

A water squirting toy including a freestanding base upon which a water gun is supported. The toy includes a garden hose connector to facilitate connection of the toy to a household water supply. The gun can be operated to discharge water directly from the household supply while supported upon the base. The toy may be provided with couplers for releasably joining the gun to the base, and the gun may include a water storage reservoir, so that the gun can be separated from the base and independently operated to discharge water.

26 Claims, 8 Drawing Sheets

WATER PROJECTING TOY

RELATED APPLICATIONS

This application is related to applicant's prior provisional application Ser. No. 60/480,026, filed Jun. 21, 2003, titled Toy Water Gun With Base. The specification of said provisional application is incorporated herein by reference. Applicant hereby claims benefits of said prior provisional application under 35 U.S.C. 119 (e).

BACKGROUND OF THE INVENTION

The invention relates to water discharging toys and amusement devices such as "sprinkler toys" and toy water guns, and more particularly to water guns mounted on a stand or continuously supplied with pressurized water via a hose.

Toy water guns have evolved to include many types, ranging from relatively small devices with a finger actuated pump to devices in which water is stored under pressure, to be released via a trigger actuated valve in a high volume, high pressure stream. U.S. Pat. No. 2,678,753 (Hersey) provides an example of the former, while U.S. Pat. No. 5,305,919 (Johnson et al.) and U.S. Pat. No. 5,799,827 (D'Andrade) exemplify the latter. Other water guns, such as those shown in U.S. Pat. No. 4,135,559 (Bamby), U.S. Pat. No. 4,257,460 (Paranay et al.) U.S. Pat. No. 4,867,208 (Fitzgerald et al.),U.S. Pat. No. 5,366,108 (Darling), U.S. Pat. No. 5,373,975 (Husted), and U.S. Pat. No. 6,234,347 (Amron et al.) include means for charging a reservoir with pressurized water through an intermittent connection to a garden hose. U.S. Pat. No. 6,474,507 (Hornsby et al.) discloses a water gun in which a reservoir may be charged through intermittent connection to a garden hose, and which may alternatively be operable while connected to a garden hose, such that intermittent refilling of the reservoir is unnecessary. While no mention is made in the Husted and Amron specifications, it appears the devices disclosed may be capable of operating while connected to a hose, in addition to storing a pressurized charge for separate use.

Sprinkler toys and decorative lawn sprinklers range from devices that connect to a garden hose and simply spray water outward and/or upward, to more elaborate devices that further utilize the force of pressurized water from the hose to operate a variety of amusing mechanisms. Examples are found in U.S. Pat. No. 2,611,645 (Forman), U.S. Pat. No. 2,046,225 (Vickery), U.S. Pat. No. 2,087,175 (Voight), U.S. Pat. No. 4,205,785 (Stanley), U.S. Pat. No. 4,235,378 (Melin et al.), U.S. Pat. No. 4,787,875 (Baron et al.), U.S. Pat. No. 5,224,652 (Kessler), U.S. Pat. No. 5,338,044 (Mazursky et al.), U.S. Pat. No. 5,403,018 (Sejnowski et al.) and U.S. Pat. No. 6,109,546 (Ogie et al.). Other garden hose connected toys include user manipulated nozzles, guns or the like that allow players to actuate and/or direct a discharge of water. Examples are found in U.S. Pat. No. 4,550,876 (Kulesza), U.S. Pat. No. 5,111,993 (Baker), U.S. Pat. No. 5,934,563 (Gapco) and U.S. Pat. No. 6,082,633 (Kephart et al.). Also known in the art are game apparatus which connect to a hose and selectively discharge water at players, such as devices disclosed in U.S. Pat. No. 5,263,714 (Rudell et al.) and U.S. Pat. No. 5,470,082 (Clayton). Other garden hose connected games include nozzles, guns or the like with which players discharge water either at targets, as in U.S. Pat. No. 3,843,127 (Lack), U.S. Pat. No. 4,165,073 (Kellerstraus) and U.S. Pat. No. 5,779,240 (Santella), or at other players, as in U.S. Pat. No. 4,113,259 (Sands) and U.S. Pat. No. 5,195,751 (Senart). Santella includes a gun connected by a flexible hose to a frame that supplies water, but the gun is not supported by the frame. Sands and Senart disclose sprayers centrally located on a game board. Sands does not allow elevation angle adjustment or a include trigger on its movable nozzle portion. Senart's game board does not include an integral garden hose connector or associated conduit. Nor does it include integral azimuth or elevation adjustment members for movably supporting a nozzle. Rather, a garden hose is fed through a sleeve in the middle of the game board and a hose sprayer is directly attached to the threaded hose end. The hose is "slidably accommodated" in the sleeve in order that the sprayer may be lifted and randomly manipulated by game participants, similar to the gun of Santella '240.

Arcade games are known in which water guns are permanently attached to the larger structure of a game apparatus. Such game apparatus typically use motorized pumps and permanent plumbing to pressurize and recirculate a self contained supply of water, and to supply the water gun therefrom. Many of these games include pistols attached to the larger apparatus only by a supply hose. The supply hose typically attaches to the pistol at the bottom portion of a handgrip, in fluid communication with a passage through the gun body and a nozzle at the opposite end of the gun. Examples are found in U.S. Pat. No. 1,499,875 (Rosenheim), U.S. Pat. No. 3,336,030 (Martell et al.), U.S. Pat. No. 3,342,492 (Barrett) and U.S. Pat. No. 3,572,712 (Vick). In some game devices, a water gun is supported on the larger apparatus such that the gun may be pivoted for aiming in both azimuth and elevation. Typically the gun's range of motion is restricted to the general direction of the game target. U.S. Pat. No. 1,526,341 (Jeans) discloses such an apparatus wherein several guns are pivotally mounted on the main structure of the apparatus. Each gun has a handgrip and trigger mounted rearward of a pivoting bracket. The bracket attaches the gun to the main structure. The trigger is connected by a mechanical linkage to a valve depending from the gun forwardly of the pivoting bracket. The valve is supplied with pressurized water from the larger apparatus via a pipe which depends from the valve, also forwardly of the mounting bracket. U.S. Pat. No. 2,285,292 (Mangels) discloses a similar gun in which the gun's trigger is an electrical switch which closes an electrical circuit to actuate a motorized pump, located externally of the gun, to thereby force water to the gun's nozzle. The gun has a rear mounted handle adjacent the electrical switch. The gun is mounted to the main structure of the game apparatus by a bracket having pivoting horizontal and vertical adjustment functions similar to those of Jeans '341, but a water supply pipe runs centrally up through the bracket. Similar apparatus are shown in U.S. Pat. No. 5,439,230 (Mendes) and U.S. Pat. No. 5,573,243 (Bartosik).

Many irrigation devices are known which are intended for connection to a garden hose and in which a rotary sprinkler head is elevated on a tripod, ground penetrating spike or similar stand. These devices generally are intended to broadcast water while unattended and thus do not require or provide means for an operator to aim or trigger the discharge. Examples are found in U.S. Pat. No. 1,368,416 (Thomas), U.S. Pat. No. 1,685,165 (Keys), U.S. Pat. No. 2,694,600 (Richey), U.S. Pat. No. 4,789,099 (Hager), U.S. Pat. No. 4,824,020 (Harward), U.S. Pat. No. 5,439,176 (Bussiere) and U.S. Pat. No. 6,322,027 (Hsu). Other irrigation and spraying devices include means for elevating a fixed sprinkler head or hose nozzle. Some include water valves and/or directional adjustments, but such features are not intended or adapted for continuous manipulation of aim or triggering. Examples are found in U.S. Pat. No. 544,928 (Patterson), U.S. Pat. No. 619,647 (Wetherby), U.S. Pat. No. 925,680 (Burns), U.S. Pat. No. 973,810 (Regan), U.S. Pat. No. 989,386 (Miller), U.S. Pat. No. 1,156,474 (Gifford), U.S. Pat. No. 1,637,523 (Hamilton), U.S. Pat. No. 2,711,927 (Miller et al.), U.S. Pat. No. 2,792,257 (Davis), U.S. Pat. No. 3,599,917 (Schwartz), U.S. Pat. No. 4,800,916 (Lakey) and U.S. Pat. No. 6,241,163 (Bremer). U.S. Pat. No. 3,012,731 (Williams) discloses a hose directing device adapted for continuous manipulation of discharge direction. The device is not freestanding and does not include a "triggered" valve.

Fire fighting nozzles and the like are often supported on devices adapted to allow adjustment of horizontal and vertical direction. Typically such devices are relatively heavy machinery permanently mounted on a fire truck, cart or other vehicle as in U.S. Pat. No. 112,969 (Shaw), U.S. Pat. No. 240,602 (McGaffey), U.S. Pat. No. 250,566 (Lynch), U.S. Pat. No. 311,905 (Logan), U.S. Pat. No. 441,697 (Prunty), U.S. Pat. No. 1,583,772 (Blaw), U.S. Pat. No. 1,835,132 (Anania), U.S. Pat. No. 2,593,921 (Robinson), U.S. Pat. No. 2,698,664 (Freeman), U.S. Pat. No. 2,998,199 (Miscovich), U.S. Pat. No. 3,010,519 (Gillespie), U.S. Pat. No. 3,989,109 (Gagliardo), U.S. Pat. No. 4,058,256 (Hobson et al.), U.S. Pat. No. 4,535,846 (Gagliardo et al.) and U.S. Pat. No. 6,179,216 (Panhelleux). Directional adjustments are generally accomplished via gear trains, hand cranks, motors, and/or positioning of the vehicle. Water flow is typically controlled from a separate device or location. U.S. Pat. Nos. U.S. Pat. No. 4,674,686 (Trapp) and U.S. Pat. No. 5,425,505 (Jones) disclose ground standing frames supporting fire fighting discharge heads. In both devices the direction of discharge may be adjusted vertically by a hand crank and horizontally by separate means. The frames do not appreciably elevate the discharge heads and no flow controls are provided. U.S. Pat. No. 139,550 (Cronin), U.S. Pat. No. 1,674,693 (MacGregor) and U.S. Pat. No. 2,501,639 (Warren) disclose nozzle supporting devices that allow operators to directly manipulate the direction of discharge. No flow controls are provided. U.S. Pat. No. 807,184 (Malnburg) discloses a tripod mounted nozzle and includes a lever for manipulating discharge direction. The tripod includes a water fitting with a shutoff valve. The movable nozzle does not include a trigger or other flow control. U.S. Pat. No. 1,738,421 (Corley) discloses a nozzle and pipe assembly on a portable stand. The direction of discharge is adjusted by grasping and moving the nozzle or pipe forward of the stand. The movable portion includes a shut off valve, but does not include a trigger or a normally closed valve.

Portable showers, wash basins and drinking fountains are found in numerous references. These typically include a ground standing base having some form of vertical riser, a water inlet including a garden hose connector, and a valve for controlling water flow between the water inlet and an outlet. The devices generally do not require or provide for significant adjustments in water discharge direction. Examples are found in U.S. Pat. No. 1,962,840 (Rives), U.S. Pat. No. 2,631,062 (Tiedemann et al.), U.S. Pat. No. 3,113,723 (Arnt), U.S. Pat. No. 3,497,140 (Puegner), U.S. Pat. No. 3,982,284 (Becker), U.S. Pat. No. 5,502,848 (Cowan), U.S. Pat. No. 5,820,472 (Briggs) and U.S. Pat. No. 5,996,142 (Colman).

Cleaning devices often employ jets of high pressure water. In some devices a spray nozzle is incorporated in an elongated hand held gun. A garden hose or other pressurized supply hose is commonly attached to a rearward handle portion of such guns, or a supply hose may be otherwise connected to the gun. Examples are found in U.S. Pat. No. 4,807,586 (Kao), U.S. Pat. No. 5,199,642 (Rankin), U.S. Pat. No. 5,66,558 (Ichel) and U.S. Pat. No. 6,131,831 (Lawrence). Other devices include a nozzle supported by a brace or stand. Examples are found in U.S. Pat. No. 4,058,259 (Schantz) and U.S. Pat. No. 4,988,063 (Pucillo). Schantz's brace requires that one end or the sprayer rest on the ground and affords no directional adjustment other than repositioning of the stand. Pucillo does not include a trigger and does not allow for continuous manipulation of discharge direction.

Portable pressurized sprayers, of the type commonly employed for garden and light industrial purposes, may be charged with water and pressurized by connection to a garden hose as in U.S. Pat. No. 4,782,982 and 4,930,664, both to Ellison. The devices disclosed are not intended for use while connected to a hose, only for charging thereby. Once charged the devices are disconnected from the hose and then hand carried. It might be possible to discharge water from the devices while still connected to a hose, but the nozzle portions are not supported for directional manipulation on a base.

Water discharging toys and amusement devices are generally known to be of a popular and commercially valuable product category. The patent record demonstrates and reflects the constant development efforts made in pursuit of such products, as well as the sometimes small incremental changes that are deemed by patent applicants to be of commercial value. In consideration of the large volume of known water toys, amusement devices and similar fluid dispensing or discharging devices, the prior art appears to be lacking with respect to a toy squirt gun supported on a stand and connected to a garden hose as disclosed herein. The present invention provides valuable developments, some subtle, some more clearly apparent, in this field.

SUMMARY OF THE INVENTION

The invention provides a novel amusement wherein a toy water gun is supported for movement in horizontal and vertical directions upon a freestanding base, and continuously supplied with water from a household supply. The base elevates and stabilizes the water gun above a surface such as a ground such that it may be manipulated for aiming and discharge by a user without the need for the user to lift or otherwise support the gun. The base preferably includes a standard garden hose coupler, for connection to a household exterior water hose or spigot, and preferably conducts water from the household supply to the movable water gun portion of the toy. In more elaborate embodiments, the water gun may include a water reservoir and be separable from the base, such that the gun may be operated while attached to the base, thus being supplied with water from the household supply, or the gun may be detached from the base and operated to discharge water from the onboard reservoir. The reservoir is preferably filled and pressurized via the gun's coupling to the base, but may optionally be filled and pressurized through other means.

DESCRIPTION OF EXEMPLARY EMBODIMENTS

Figure 1:
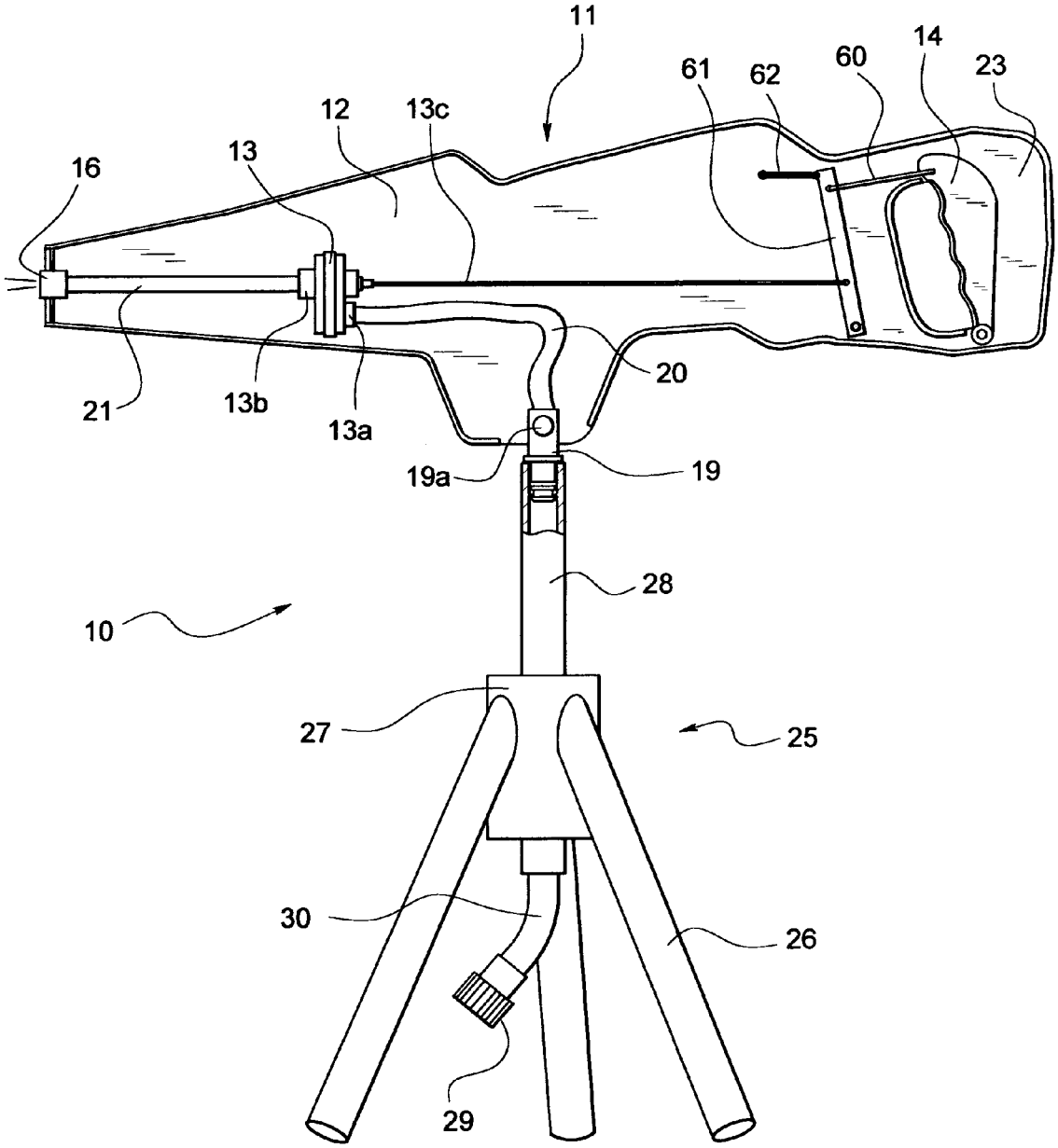
FIG. 1 is a side view in partial section of a water gun and supporting stand or base in accordance with the present invention.

FIG. 1 depicts, by way of illustration and not of limitation, a water gun apparatus 10 constructed in accordance with the present invention. The apparatus comprises a gun 11 having a frame or housing 12 which provides support for other elements of the gun including a valve 13, trigger 14, nozzle 16, a swivel coupler 19, conduits 20 and 21 and a hand grip 23. The apparatus further comprises a free standing, portable base 25 upon which the gun 11 is supported. The base illustrated is a tripod, but other free standing base structures may be employed. The base 25 comprises three legs 26 joined at a central hub 27, a rigid vertical tube 28, a standard female threaded garden hose coupler 29 and a conduit 30 that connects the hose coupler 29 to the vertical tube 28. Conduit 30 is constructed of any suitable rigid or flexible material.

Figure 2:
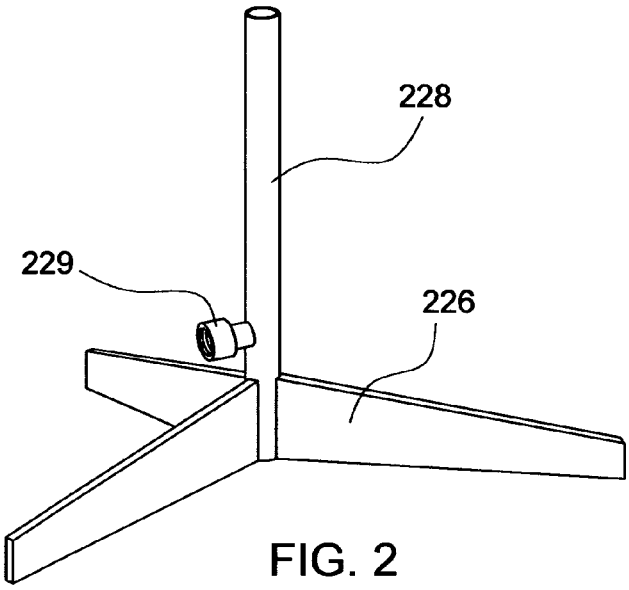
FIGS. 2, 3, 4 and 5 illustrate alternative bases that may be incorporated with a water gun according to the invention.
Figure 5:
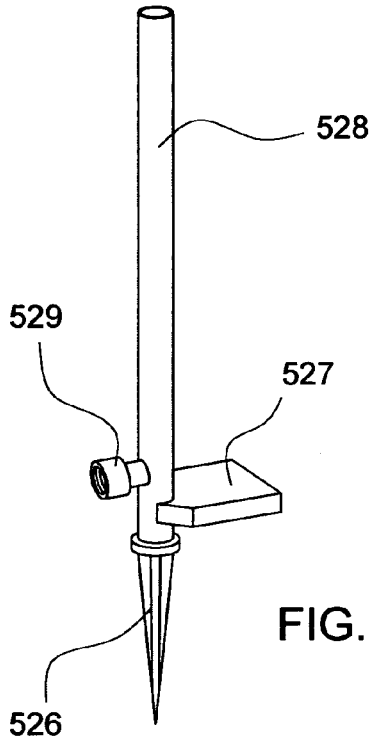
Figure 3:
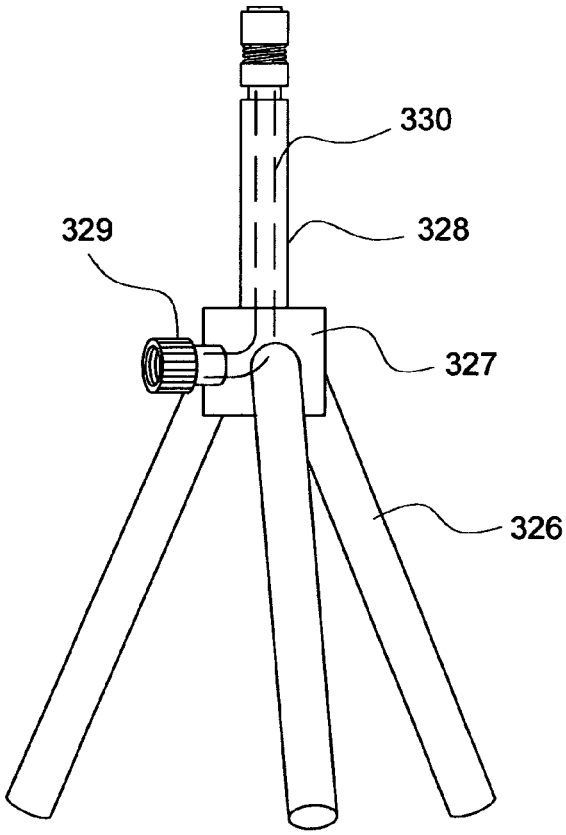
Figure 4:
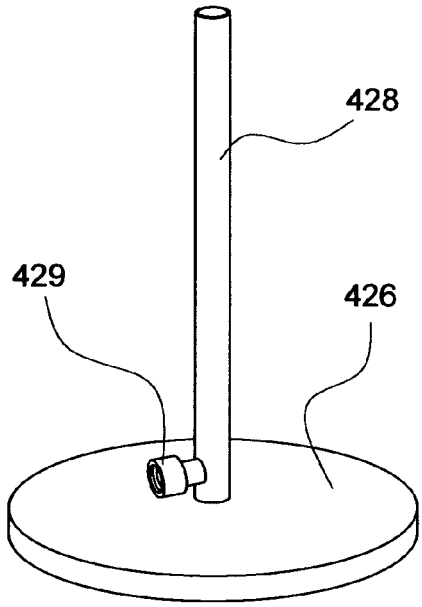

FIGS. 2 through 5 illustrate several alternative base styles. Each base includes stabilization means to allow the apparatus to stand upright without external support other than from a ground, vertically rising means to elevate a gun to a usable height above the ground, and a standard threaded female garden hose coupler for connecting the base to a household water supply. Each base further includes conduit to establish a fluid path from the garden hose connector to the gun. A tubular riser member may function as conduit in this respect, or separate tubes, pipes or the like may be employed, such as a separate tube 330, shown in phantom in FIG. 3, running through a hub 327 and riser 328. The bases of FIGS. 2–4 utilize feet 226, legs 326 and a single enlarged foot 426, respectively, for stable support upon a ground. The base of FIG. 5 employs a spike 526 for insertion into a ground, and includes a foot peg 527 that a user may step upon to facilitate insertion of the spike. FIGS. 2, 4 and 5 illustrate the use of single tubular risers 228, 428 and 528, while FIG. 3 illustrates the use of legs 326 as both stabilizers and risers.

Figure 6:
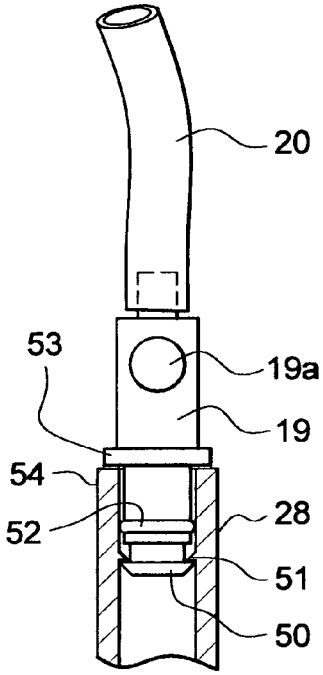
FIG. 6 is a side view in partial section of a swivel coupling that joins the gun and base of FIG. 1.
Figure 11:
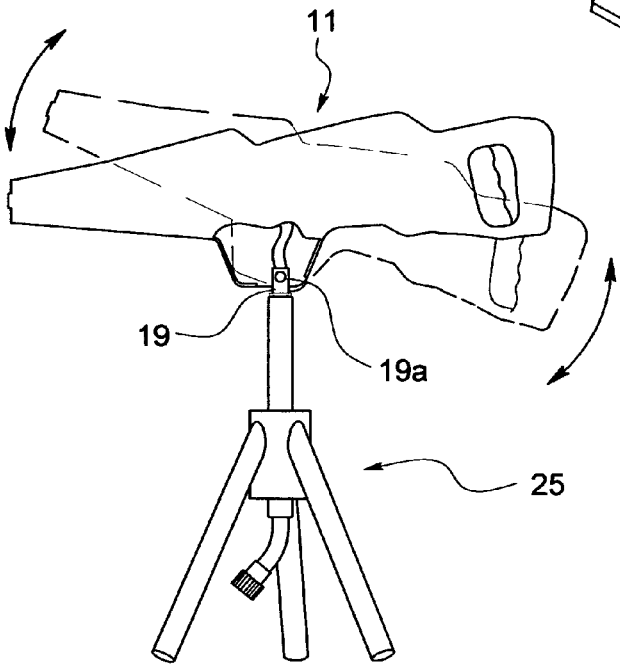
FIG. 11 illustrates adjustable discharge elevation angle in the apparatus of FIG. 1.
Figure 13:
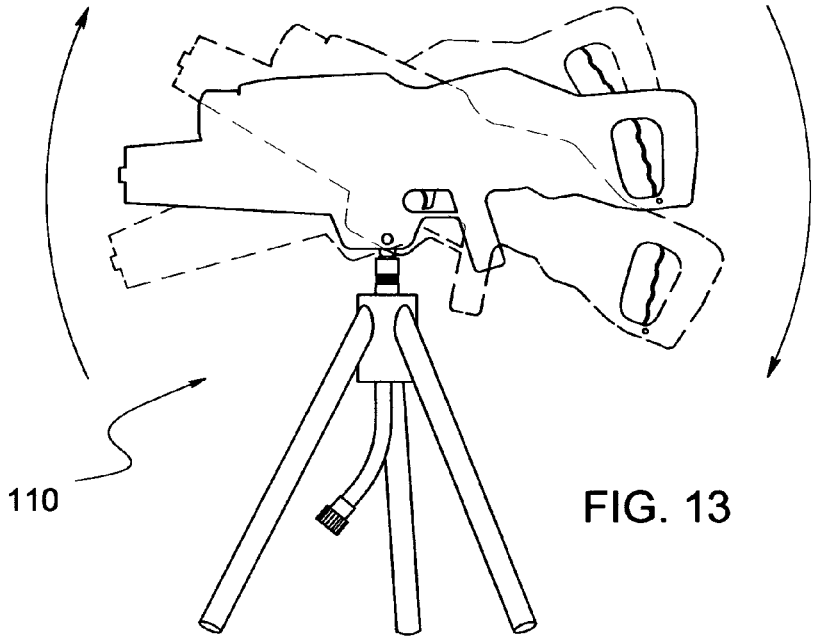
FIG. 13 illustrates adjustable discharge elevation angle in the apparatus of FIG. 15.
Figure 12:
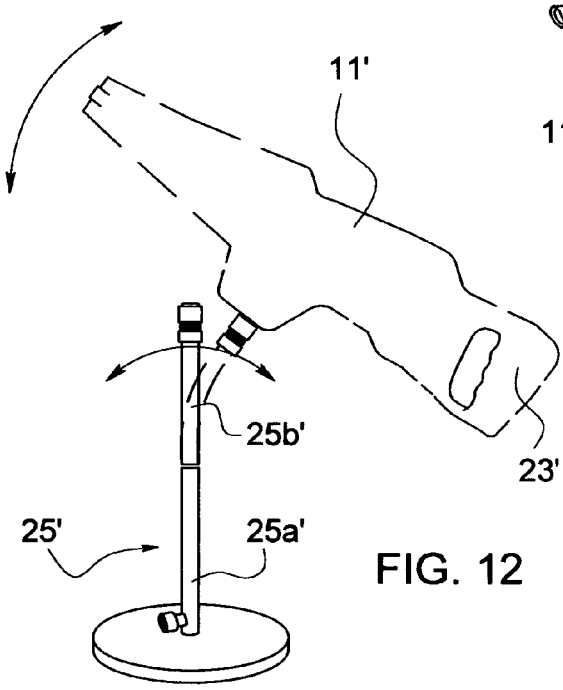
FIG. 12 illustrates an alternative base structure for facilitating elevation angle adjustment in a toy incorporating the invention.

With reference to FIGS. 1 and 6, swivel coupler 19 is received within the upper end of tube 28 and retained therein by engagement of an annular lip 50 with an annular protrusion 51 inside the tube. Water flows from hose connector 29 through conduit 30, tube 28, swivel coupler 19 and flexible conduit 20 to an inlet 13*a* of the valve 13. An o-ring seal 52 prevents leakage between the tube 28 and the coupler 19. Weight of the gun is borne upon the base by engagement of an annular shoulder 53 of swivel 19 and the upper end 54 of the tube. The swivel 19 is free to rotate within the tube 28, thus providing for horizontal adjustment of the gun's direction of discharge. The swivel coupler 19 is pivotally attached to the gun housing 12 via engagement of cylindrical posts 19*a* with corresponding receptacles (not shown) on the housing. Thus the gun 11 may be pivoted about a second axis, as illustrated In FIG. 11, to provide for vertical adjustment of discharge direction. FIG. 12 illustrates an alternative vertical adjustment configuration whereby a swivel coupler 19' is non-movably attached to the gun housing (with respect to vertical discharge direction). The gun 11' is supported on a stand 25' having a lower rigid section 25*a*' and an upper flexible section 25*b*'. The flexible portion is easily bent by application of force to the handgrip 23', thus serving as a hinge to pivot the gun 11' about the rigid portion of the stand 25'.

Figure 8:
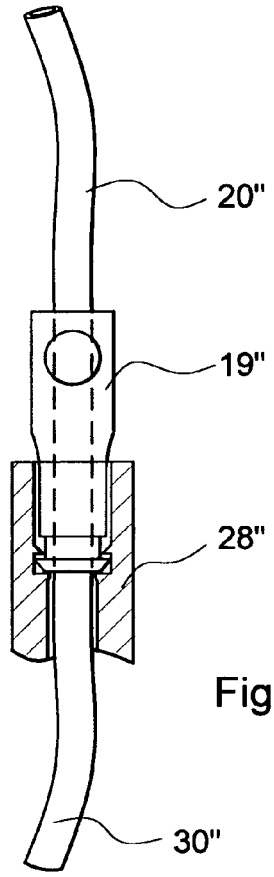
FIGS. 7 and 8 illustrate alternative swivel couplings that may be employed to join a gun and base in accordance with the invention.
Figure 7:
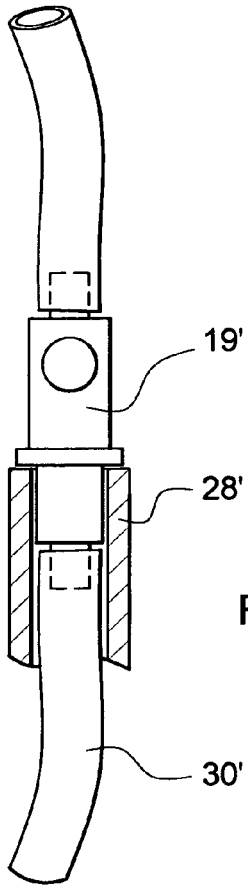

FIGS. 7 and 8 illustrate alternative plumbing arrangements between the gun 11 and base 25. In FIG. 7 conduit 30' is configured as a flexible tube extending through rigid tube 28' and attaching to the lower end of swivel 19'. In FIG. 8, conduit 30" is configured as an extension of conduit 20" from the gun 11, passing through the swivel coupler 19" and the vertical tube 28". Both of these arrangements will limit horizontal rotation of the gun to that allowed by the twisting of conduit 30' or 30", whereas rotation is unlimited with the arrangement illustrated in FIG. 6.

With reference again to FIG. 1, it may be observed that the gun is discharged by manipulation of the trigger 14 to open the valve 13 via a linkage 60 and a lever 61. The valve 13 is preferably of a normally closed type, biased to prevent water flow. The trigger 14 is pulled toward the handgrip 23, which moves linkage 60 rearward to pivot lever 61. Lever 61 in turn pulls a rod 13*c* rearward to open an internal passage of valve 13, thereby allowing water to flow from the valve inlet 13*a* to its outlet 13*b*. Conduit 21 conducts water from valve outlet 13*b* to the nozzle 16, from which it is discharged. Upon release of the trigger 14, a spring 62 returns the trigger, linkage 60 and lever 61 to their rest positions. Other flow gating structures may be suitably employed to selectably inhibit or enable water flow, including many types found in the prior art of water guns, such as ball valves, plunger valves, and "pinch" valves wherein a flexible tube is pinched or clamped to close a water passage.

Figure 10:
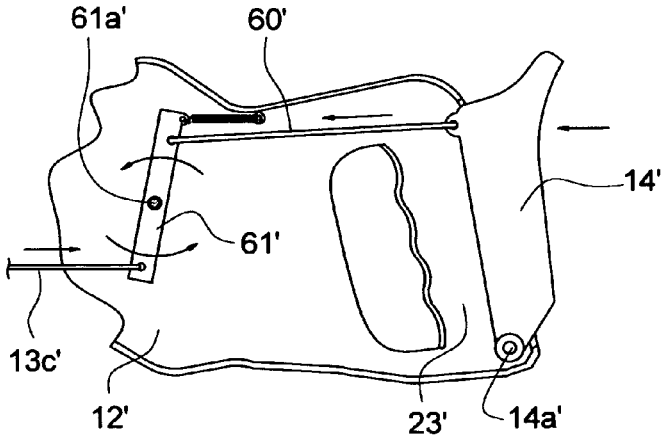
FIG. 10 depicts an alternative trigger configuration that may be employed in the gun of FIG. 1.
Figure 9:
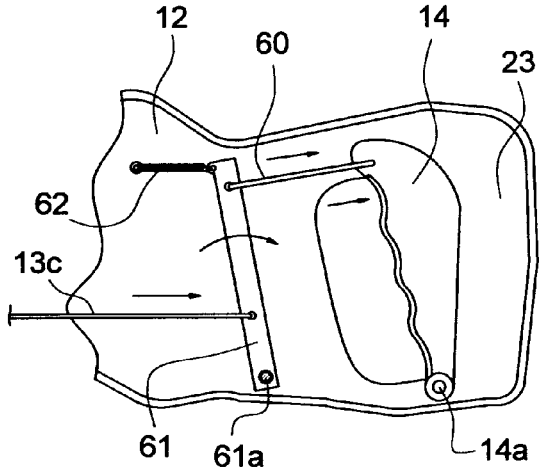
FIG. 9 is a side view of the trigger of the gun in FIG. 1.

FIGS. 9 and 10 illustrate a "pull" trigger and a "push" trigger, respectively, that may be incorporated in embodiments of the invention. FIG. 9 provides an enlarged depiction of the trigger 14 described above. The trigger is pivoted about a post 14*a* on the gun housing 12. Clockwise motion of the trigger 14 results in similar clockwise rotation of the lever 61 about a second post 61*a*, such that rod 13*c* is pulled rearward with respect to the housing to open valve 13. The "push" trigger 14' of FIG. 10 is actuated by pivoting it in the counterclockwise direction about a post 14*a*'. In this configuration, the user's fingers are wrapped around the handgrip 23' and the trigger 14' is engaged by the palm of the user's hand. The lever 61' in this configuration is pivoted intermediate linkage 60' and valve rod 13*c*' such that counterclockwise rotation of the trigger 14' and lever 61' again results in rearward motion of the rod 13*c*' to open the valve. Other trigger configurations, such as triggers actuated by a single finger, push buttons or sliding triggers, may similarly be used to open valves in other embodiments of the invention.

Figure 15:
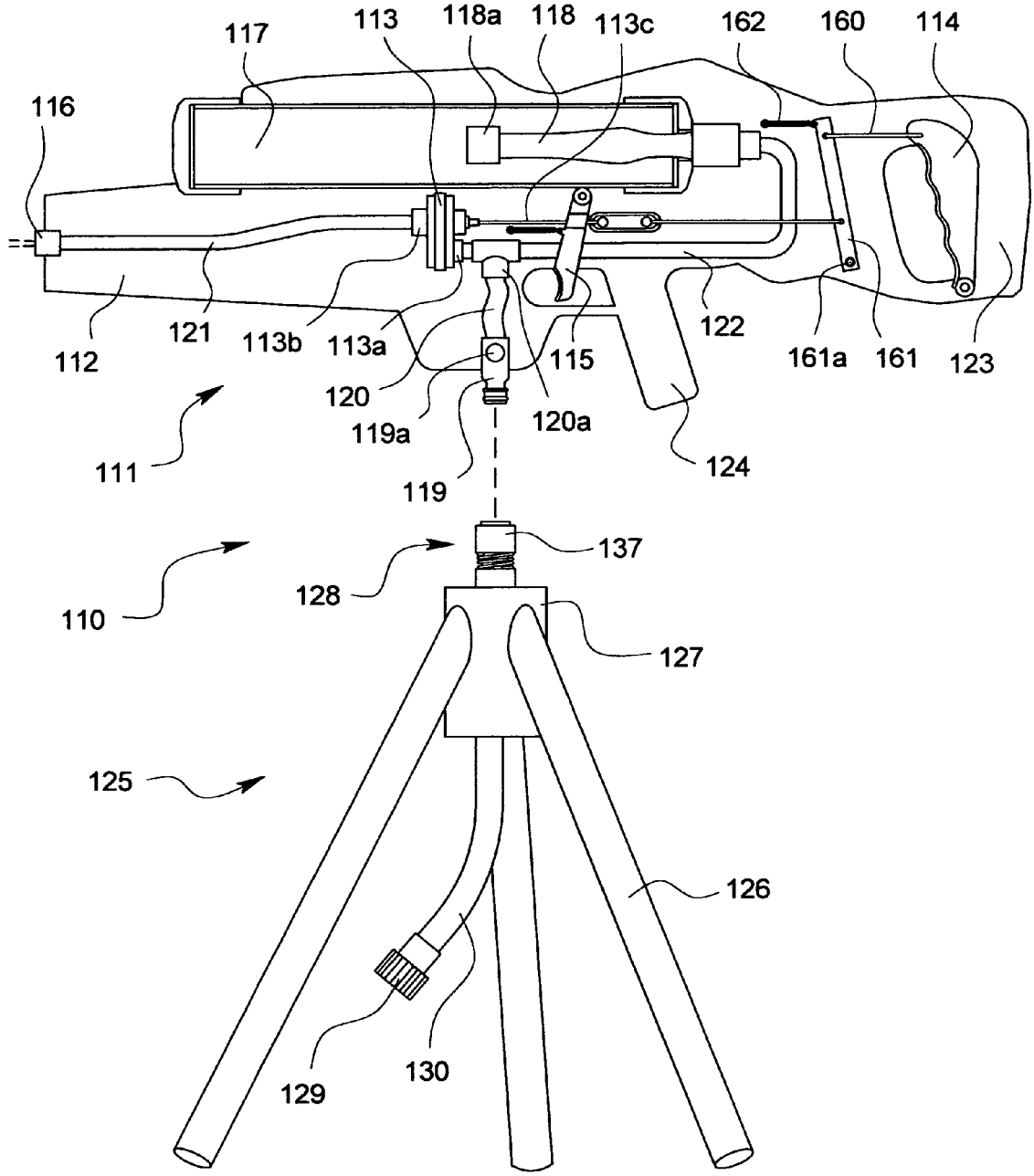
FIG. 15 is a side view in partial section of an embodiment of the present invention incorporating a water gun and supporting stand that are separable.

FIG. 15 depicts, by way of illustration and not of limitation, another water gun apparatus 110 constructed in accordance with the present invention. The apparatus comprises a gun 111 having a frame or housing 112 which provides support for other elements of the gun including a valve 113, triggers 114 and 115, nozzle 116, water reservoir 117, bladder 118, a "quick connect" coupler 119, conduits 120, 121, and 122, and hand grips 123 and 124. The apparatus further comprises a free standing base 125 upon which the gun 111 may be supported. The base illustrated is a tripod, but other free standing base structures may be employed. The base comprises three legs 126 joined at a central hub 127, a quick connect coupler 128, a standard female threaded garden hose coupler 129 and a conduit 130 that provides a fluid path between "quick" coupler 128 and hose coupler 129. Conduit 130 is constructed of any suitable rigid or flexible material or combinations thereof. The legs 126 provide three point stabilization of the apparatus and also serve in combination as a vertical riser to elevate the gun to a convenient height for operation.

Figure 18:
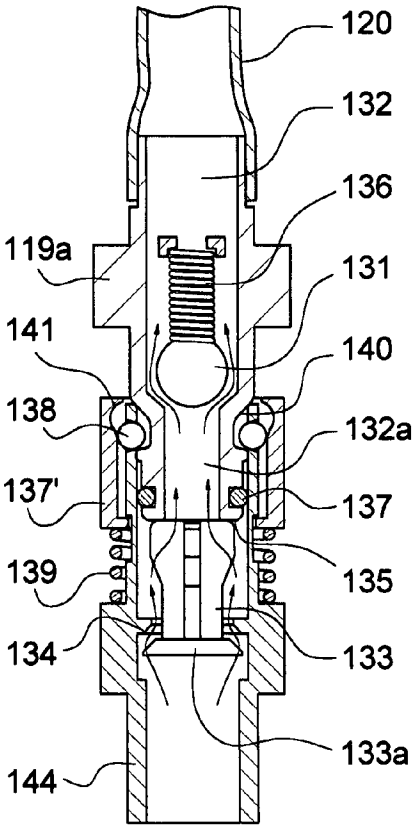
FIG. 18 is a sectional side view of the couplers of FIG. 16, in which the couplers are mutually engaged.
Figure 17:
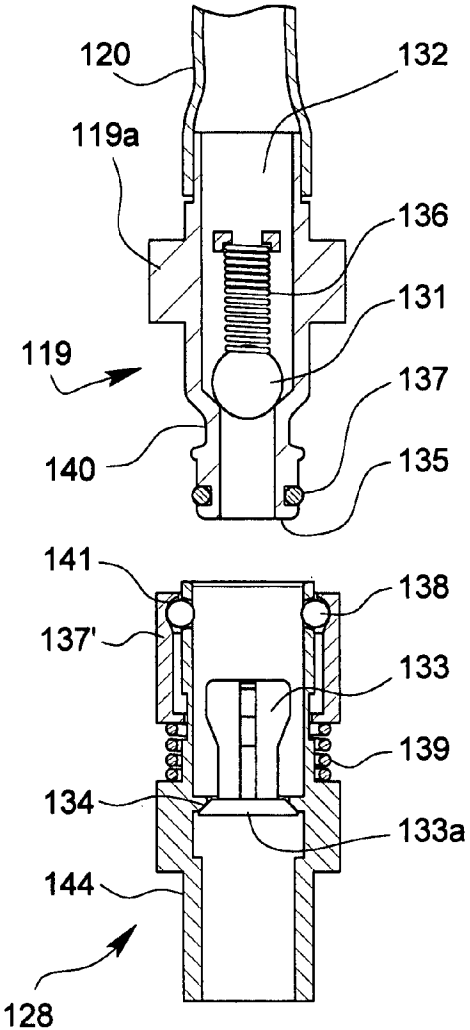
FIG. 17 is a sectional side view of the couplers of FIG. 16.
Figure 16:
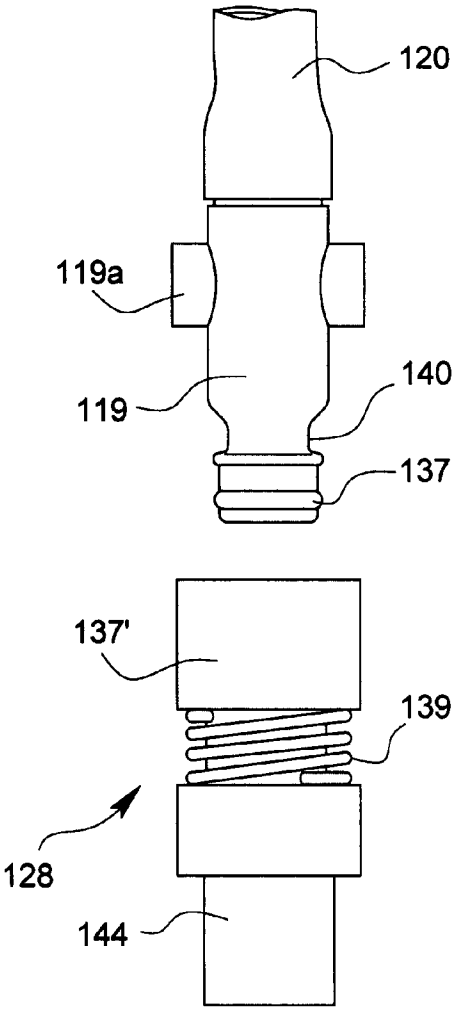
FIG. 16 is a side view of a pair of couplers used to join the gun and stand, or base, of FIG. 15.

FIGS. 16, 17 and 18 depict typical details of quick couplers 119 and 128. The couplers 119 and 128 are male and female, respectively, in this embodiment, by design choice and not by necessity. Other coupling configurations may be employed. Both couplers preferably include one-way check valve components to prevent water flow upon disconnection of the pair. Coupler 119 includes a ball 131 biased to close an internal passage 132 so that water cannot flow out from conduit 120. Coupler 128 includes a movable member 133 having a head 133*a* which is forced into sealing engagement with a seat 134 by water pressure within conduit 130. Upon insertion of the male coupler 119 into the female coupler 128 (ref. FIG. 18), the tip 135 of the male coupler displaces the movable member 133 to allow water to flow past the seat 134 and into the tip portion 132*a* of passage 132. Elevated pressure of the water forces the ball 131 against the bias of a spring 136 such that water flows past the ball and through the passage, as indicated by arrows in FIG. 18. The male coupler 119 includes an o-ring seal 137 to prevent leakage between the two couplers. The female connector 128 employs a movable collar 137 and a number of balls 138 to retain or release the male coupler. FIG. 18 depicts the two couplers in engagement, with the collar 137 biased to its normal retaining position by a spring 139. The balls 138 are radially movable within holes 142 of the cylindrical body 143 of coupler 128 and are retained within the holes by a beveled inside edge of the hole and by the collar 137. The inner surface of the collar drives balls 138 radially inward to engage a reduced diameter section 140 of the male coupler, thereby preventing separation of the two couplers. The couplers are disengaged by manually retracting the collar (downward movement with respect to the figures) so that the balls 138 are able to move radially outward into an enlarged inside diameter section 141 of the collar, as depicted in FIG. 17.

A lower neck 144 of coupler 128 may be mechanically connected to a separate conduit 30 (ref. FIG. 15) or may be extended to incorporate all or part of such a conduit. As previously discussed in reference to the embodiment of FIG. 1, the embodiment of FIG. 15 may employ other base configurations, such as but not limited to, those illustrated in FIGS. 2 through 5. The coupler 128 may be attached to, incorporate or be incorporated in various conduits, risers and/or hubs of such bases.

Figure 14:
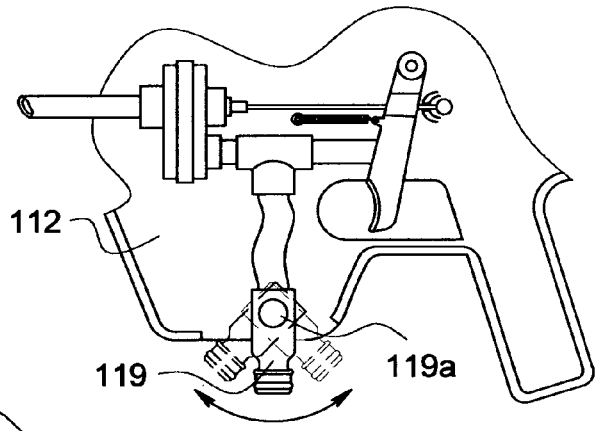
FIG. 14 depicts a pivoting connector from the apparatus of FIG. 15.

The coupler 119 includes a pair of cylindrical posts or protrusions 119*a* which are pivotally received within suitable receptacles on the gun housing 112, whereby the coupler 119 may be pivoted through a reasonably wide arc with respect to the gun, as illustrated in FIG. 14. Thus, the gun 111 may be pivoted for adjustment of elevation angle, i.e., the vertical direction of discharge. Alternatively, the coupler 119 may be in fixed position on the gun and the other coupler 128 may be pivotally engaged on the base to provide similar vertical adjustment capability. Likewise, vertical adjustment of discharge direction may be facilitated by a flexible riser member on the base, as has been described with reference to FIG. 12, or by a similarly flexible member incorporated in the gun.

The manner of adjustment of the horizontal direction of discharge, or azimuth angle, is similar to that described for the embodiment of FIG. 1. The coupler 119 of the gun 111 is free to rotate within the coupler 128 of the base 125. Thus, the gun may be freely rotated with respect to azimuth.

In operation, the gun 111 is initially mounted onto the base by engagement of coupler 119 to coupler 128 as has been described. With the base operably coupled to a household water supply via garden hose connector 129, and with such supply placed in condition to cause pressurized water to be provided to connector 129, water will flow through the base and into conduit 120 of the gun 111. The conduit branches through a splitter 120*a* so that pressurized water is provided both to the valve inlet 113*a* and to the expandable bladder 118 within reservoir 117, via conduit 122. A first end of the bladder 118 is in fluid communication with conduit 122. A second end of the bladder is sealed by a plug 118*a*. Application of pressurized water causes the bladder to expand within the reservoir until it substantially fills the reservoirs interior. Note that the branching function of splitter 120*a* may be incorporated in or provided by other elements of the gun, such as coupler 119, valve 113 or bladder/reservoir 118/117.

Actuation of the rearmost trigger 114 (i.e., squeezing the trigger toward the handgrip 123) causes the valve 113 to be opened, whereby water is discharged from the nozzle 116. As may be better observed with reference to FIG. 19, the trigger 114, pivoted about a post 114*a*, pulls back a linkage 160 to pivot a lever 161 about a post 161*a*. The lever pulls a linkage 163 rearward. The linkage includes a bead 163*a*, which engages and moves a coupler 164 that joins the linkage 163 to valve actuating rod 113*c*. The coupler pulls rod 113*c* rearward to open the valve, allowing water to flow from inlet 113*a* to outlet 113*b*, through conduit 121 and to nozzle 116 (ref. FIG. 15) for discharge therefrom.

Figure 19:
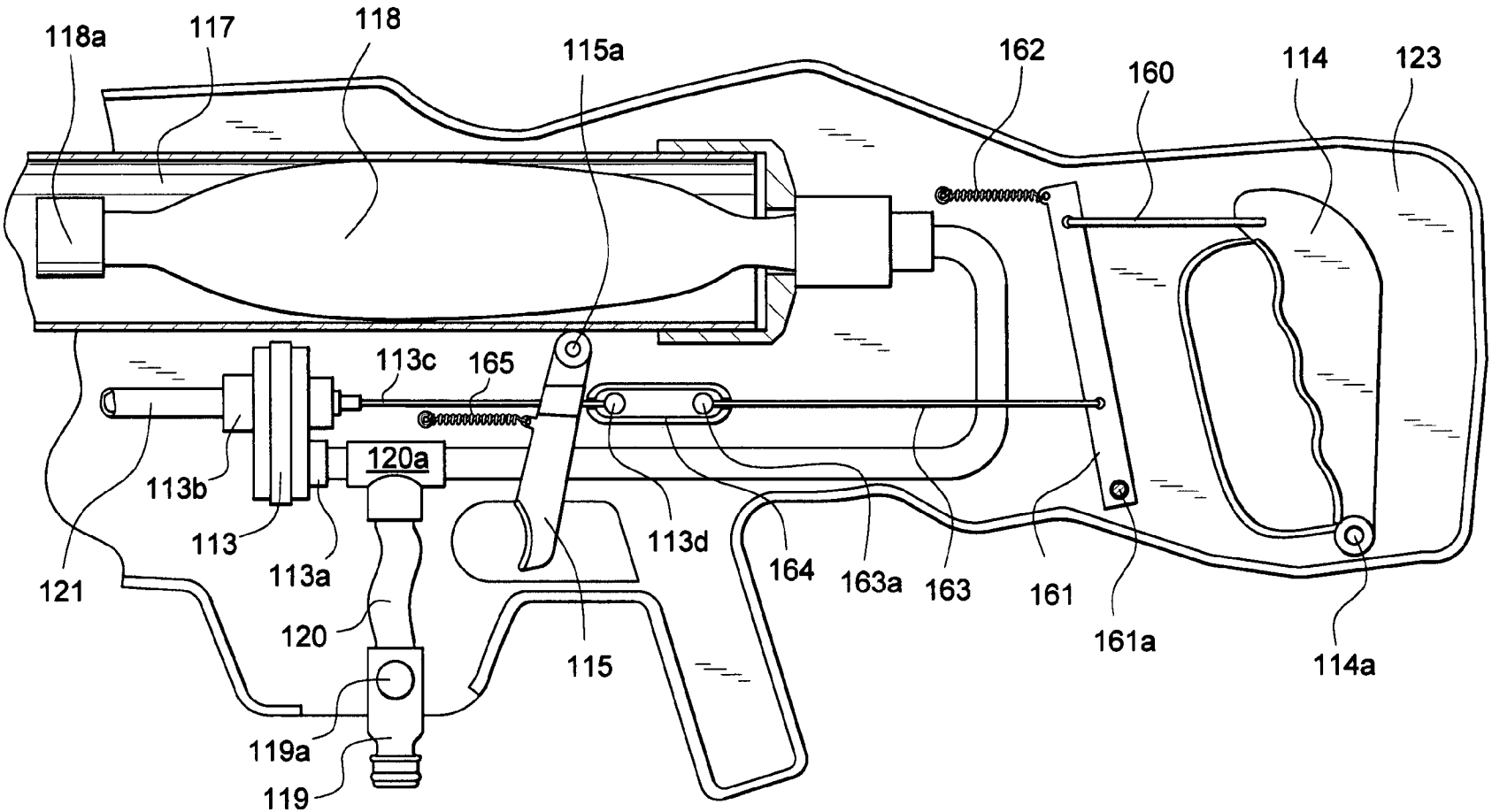
FIG. 19 is a side view in partial section of the water gun of FIG. 15.

Once the bladder 118 has been at least partially filled, as depicted in FIG. 19, the gun 111 may be operated while separated from the base 125. A user releases the gun from the base by disengaging couplers 119 and 128 as has been described with reference to FIGS. 16, 17 and 18. The gun may then be held by the user and operated by actuation of trigger 114, or more conveniently, by actuation of the second trigger 115, which pivots about a post 115*a*. As trigger 115 pivots rearward it engages the forward end of coupler 164, pushing the coupler rearward. The coupler engages a bead 113*d* on rod 113*c*, pulling the bead and rod rearward to open valve 113. A spring 165 biases trigger 115 forwardly. It may be noted that the other end of coupler 164 slidingly receives linkage 163, so that the linkage is not affected by rearward movement of the coupler 164. Thus, actuation of trigger 115 does not cause movement of the rear trigger 114. Likewise, since trigger 115 is not affixed to either the rod 113*c* or coupler 164, actuation of rear trigger 114 does not cause movement of forward trigger 115.

With the gun 111 separated from the base 125, bladder 118 provides a supply of water to the valve inlet 113*a*. Water is prevented by ball 131 from exiting through coupler 119 (ref. FIG. 17). Water pressure is provided by resilience of the expanded bladder 118, which is preferably constructed of a highly elastic rubber or similar material. The presently illustrated reservoir 117 provides support for bladder 118 and limits its expansion to guard against rupture. However, the illustrated components are not to be construed as limiting. A bladder may be otherwise supported and otherwise protected from overfilling, and may itself incorporate functional aspects of the illustrated reservoir. Further, while an elastic bladder has been illustrated, other expandable chambers may be incorporated, such as a bellows or a piston and cylinder. Water discharging pressure can be provided by means such as biasing springs or manual force.

Other storage and pressurizing means may be incorporated in place of, or in addition, to those that have been described and illustrated. For instance, while the illustrated reservoir 117 is preferably not airtight, a similar airtight tank may be used in combination with an elastic bladder, a non-elastic bladder or no bladder at all, whereby air trapped within the tank will be compressed as the tank or bladder becomes filled by water, thereby providing pressure to expel water from the gun. A pump might be added to allow air pressure within such a reservoir to be increased manually by a user. A non-pressurized tank may be incorporated, along with a pump, whereby the tank might be filled by connection of the gun to the base, for subsequent pressurization of the tank by the pump, or for subsequent transfer of water, via the pump, to a pressurized tank or bladder. A pump might be employed to directly discharge water from a non-pressurized tank. Additional air and/or water containers and pumps may be added and/or substituted for those described, to provide design variations, without deviating from the spirit and scope of the invention.

While embodiments of the invention and variations thereto have been described in this specification, it is noted that the present embodiments are intended to be considered as illustrative, and not restrictive upon the scope of the invention. Variations, modifications and improvements will likely occur to persons of average skill in the art, upon consideration and understanding of the embodiments presented. It is therefore the intent of the following claims to include all such variations, modifications, alterations and improvements that fall within the true spirit and scope of the invention.

What is claimed is:

1. A water projecting toy comprising a base and a portable gun;

said base adapted to receive said gun and to provide a supply of water to said gun;

said gun and base each adapted for detachable engagement to the other; said gun, when properly engaged with said base, being supported and retained thereby in an operational configuration such that under control of a user said gun may discharge water supplied by said base;

said gun including a container for storing water received from said base;

said gun being removable from said base; said gun including water propelling means adapted to allow a user to discharge water stored in said container from said gun while said gun is detached from said base.

2. A water projecting toy as set forth in claim 1 wherein said gun includes a flow gate and a nozzle;

said flow gate having first and second operational states; said first operational state preventing flow of water to said nozzle; said second operational state allowing flow of water to said nozzle;

said flow gate controlling flow of water to said nozzle from said base when said gun is operationally engaged with said base.

3. A water projecting toy as set forth in claim 2 wherein said gun includes a chamber; said chamber adapted to store pressurized water; said flow gate controlling flow of water to said nozzle from said chamber when said gun is detached from said base.

4. A water projecting toy as set forth in claim 3 wherein said chamber is an expandable chamber biased toward a nonexpanded state; said base adapted to provide pressurized water to said chamber when engaged with said gun; pressurized water applied to said chamber causing said chamber to expand to store a volume of said water; bias of said chamber providing force to propel said water from said chamber for discharge from said nozzle upon said gun being removed from said base and said flow gate being placed in said second operational state.

5. A water projecting toy as set forth in claim 4 wherein said expandable chamber comprises an elastic bladder.

6. A water projecting toy as set forth in claim 2 wherein said base includes means for connecting said base to a household water system to receive pressurized water therefrom; said water projecting toy further comprising first and second conduit members incorporated in said base and said gun, respectively; said first conduit member in fluid communication with said base connecting means; said second conduit member in fluid communication with said flow gate and said container; said first and second conduit members being connected when said gun is operationally supported on said base, whereby said base connecting means is in fluid communication with said flow gate and said container.

7. A water projecting toy as set forth in claim 6 wherein said gun includes a trigger; said trigger operable by a user of said toy to switch said flow gate between said first and said second operational states.

8. A water projecting toy as set forth in claim 7 wherein said flow gate is a valve.

9. A water projecting toy comprising a base and a portable gun;

said gun comprising a container, a trigger, a valve and a nozzle;

said base including a connector adapted for connection to a household water system such that said base may receive pressurized water from said system;

said base adapted to releasably receive and support said gun; said base adapted to conduct pressurized water from said connector to said gun; said gun adapted to receive pressurized water from said base and to conduct said water to said container and to said valve; said trigger operable by a user to open said valve; said valve being in fluid communication with said nozzle; said valve when opened conducting pressurized water through said gun to said nozzle for discharge therefrom; said valve when closed preventing flow of water to said nozzle;

said gun operable while supported on said base to discharge water received through connection to a household water system; said gun operable while removed from said base to discharge water stored in said container.

10. A water projecting toy as set forth in claim 9 wherein said base comprises a free standing structure adapted to elevate said gun above a generally horizontal surface and to support and retain said gun in an operable orientation allowing variable aiming and discharge of said gun upon said base.

11. A water projecting toy as set forth in claim 9 wherein said container includes a chamber adapted to store pressurized water; said valve controlling flow of water to said nozzle from said chamber when said gun is detached from said base.

12. A water projecting toy as set forth in claim 11 wherein said chamber is an expandable chamber biased toward a nonexpanded state.

13. A water projecting toy as set forth in claim 12 wherein said gun is adapted to conduct pressurized water from said base to said chamber; suitably pressurized water applied to said chamber causing said chamber to expand to store a volume of said water; bias of said chamber providing force to propel said water from said chamber for discharge from said nozzle upon said gun being removed from said base and said valve being opened.

14. A water projecting toy as set forth in claim 13 wherein said expandable chamber comprises an elastic bladder.

15. A portable water projecting toy comprising a base and a gun;

said water projecting toy being relatively lightweight and compact whereby said toy may be transported from one location to another with reasonable ease by an average child;

said gun including a trigger, a valve and a nozzle;

said valve having an input and an output;

said base including a garden hose connector adapted for connection to and supply from a household water system;

said water projecting toy including conduit establishing fluid communication between said garden hose connector and said valve input; said valve output being in fluid communication with said nozzle; said trigger operatively linked to said valve for selective actuation thereof to allow water to flow from said valve input to said valve output, such that pressurized water supplied from a connected household water system may flow from said garden hose connector through said conduit and valve, to said nozzle, to be discharged from said gun;

said base including rigid structure for stabilizing itself with respect to a horizontal surface such as a ground surface; said base including means for supporting and retaining said gun in an operable configuration upon said base; said base including structure which elevates said gun a distance above said horizontal surface such that an average child may, with reasonable ease, operate said gun on said base from a kneeling or standing position;

said water projecting toy including means allowing movement of said gun relative to said base, while said gun is supported upon said base, such that an operator may manipulate said gun for discharge of water in variable directions with respect to said base.

16. A water projecting toy as set forth in claim 15 wherein said means allowing movement of said gun relative to said base includes a swivel joint; said swivel joint allowing angular movement of said gun about a generally vertical axis so that said gun may be variably aimed in azimuth.

17. A water projecting toy as set forth in claim 16 wherein said means allowing movement of said gun relative to said base includes a second swivel joint; said second swivel joint allowing said gun to pivot about a generally horizontal axis so that said gun may be variably aimed in elevation.

18. A water projecting toy as set forth in claim 16 wherein said means allowing movement of said gun relative to said base includes a flexible member allowing tilting of said gun about a generally horizontal axis so that said gun may be variably aimed in elevation.

19. A water projecting toy as set forth in claim 15 wherein:

said gun has an elongated body with said nozzle positioned in general proximity to a forward end of said body, and said trigger positioned in general proximity to an opposite rearward end;

said gun further including an interface for engagement with said base such that said gun is thereby supported upon said base, said interface being intermediately positioned with respect to said trigger and said nozzle; said interface including a portion of said conduit establishing fluid communication between said garden hose connector and said valve; said interface allowing said gun to pivot upon said base about said conduit portion, for variable aim in azimuth.

20. A water projecting toy as set forth in claim 15 wherein:

said gun includes a container for storing water; said container being in fluid communication with said conduit, such that said container may be supplied with water by a household water system operably connected to said base, and such that said container may supply water to said valve input; said toy including means for separating said gun from said base, whereby said gun is not in fluid communication with said base; said gun being operable to discharge water from said container, through said valve and nozzle, when separated from said base.

21. A water projecting toy as set forth in claim 20 wherein said conduit includes at least two members detachably connectable to each other. A first one of said conduit members being incorporated in said base and a second one of said conduit members being incorporated in said gun; said first and second conduit members being connectable to each other to establish fluid communication of said valve and container with said garden hose connector when said gun is operably supported on said base; said first and second conduit members being separable from each other to allow removal of said gun from said base.

22. A water projecting toy as set forth in claim 21 wherein said container includes an expandable chamber biased toward a nonexpanded state; pressure from an operationally connected household water system causing said chamber to expand and fill with water from said system.

23. A water projecting toy as forth in claim 22 wherein said gun includes a valve that automatically prevents water in said expandable chamber from exiting said gun via said second conduit member when said gun is detached from said base.

24. A water projecting toy as set forth in claim 22 wherein said gun includes a valve that automatically prevents water flow from said first conduit member when said second conduit member is detached therefrom.

25. A water projecting toy as set forth in claim 22 wherein said expandable chamber comprises an elastic bladder.

26. A water projecting toy as set from in claim 22 wherein bias of said chamber toward a nonexpanded state provides force for discharge of water from said gun.

* * * * *